United States Patent [19]

Hodge

[11] Patent Number: 5,054,550

[45] Date of Patent: Oct. 8, 1991

[54] CENTERING SPINNING FOR DOWN HOLE TUBULARS

[75] Inventor: Lee R. Hodge, Corsicana, Tex.

[73] Assignee: W-N Apache Corporation, Wichita Falls, Tex.

[21] Appl. No.: 528,246

[22] Filed: May 24, 1990

[51] Int. Cl.[5] ..... B25B 17/00

[52] U.S. Cl. ..... 166/78; 81/57.19

[58] Field of Search ..... 166/77.5, 78, 85; 175/195; 81/57.15, 57.19, 57.2

[56] References Cited

U.S. PATENT DOCUMENTS

| | | | |
|---|---|---|---|
| 3,906,820 | 9/1975 | Hauk | 166/78 X |
| 4,099,429 | 7/1978 | Hauk | 166/78 X |
| 4,366,606 | 1/1983 | Willis et al. . | |
| 4,403,666 | 9/1983 | Willis . | |
| 4,446,761 | 5/1984 | Boyadjieff et al. | 81/57.19 |
| 4,821,814 | 4/1989 | Willis et al. . | |

FOREIGN PATENT DOCUMENTS

| | | | |
|---|---|---|---|
| 625019 | 9/1978 | U.S.S.R. | 81/57.19 |

*Primary Examiner*—William P. Neuder
*Attorney, Agent, or Firm*—Willian Brinks Olds Hofer Gilson & Lione

[57] ABSTRACT

A centering spinner for centering and spinning down hole tubulars having a range of diameters. The centering spinner includes a frame capable of admitting a down hole tubular therein and a plurality of roller assemblies pivotally coupled to the frame to converge upon and center the down hole tubular. According to a further feature, adjacent rollers of the roller assemblies of the centering spinner are axially displaced with respect to a down hole tubular retained therein.

31 Claims, 2 Drawing Sheets

CENTERING SPINNING FOR DOWN HOLE TUBULARS

BACKGROUND OF THE INVENTION

The present invention relates to devices to rotate down hole tubulars and, more particularly, to devices that both rotate and center down hole tubulars.

The term "down hole tubular", as used herein, refers severally to drill pipes, drill collars, casings, production tubing, and the like such as may be used in drilling and production operations.

In such operations, lengths of individual down hole tubulars are connected in order to make a string of down hole tubulars necessary for the particular application. The connection of lengths of down hole tubular to make a string is referred to as "making up" and the disconnection of a string is referred to as "breaking down". The equipment for making up and breaking down a sting of down hole tubulars is located on the surface adjacent to the drill hole typically on a drilling floor.

The making up of a string of down hole tubulars requires the lifting and aligning of an individual length of down hole tubular to be added with respect to another down hole tubular. Typically, this means that the length of down hole tubular to be added is suspended over, aligned and then connected to another down hole tubular (which may be part of a string of down hole tubulars which may be partially beneath the surface of the earth). The down hole tubular to be added may be connected to the down hole tubular already in place by threading the two of them together either directly or with a coupling. This making up operation necessarily requires that the one down hole tubular to be added must be centered and rotated with respect to the other down hole tubular while it is suspended.

Typically, several different diameters of down hole tubulars are used on an operation. For example, production tube may be $2\frac{7}{8}$ inches in diameter, drill pipe may be 3–12 inches in diameter, and casing may be up to 32 inches in diameter. As explained above, with respect to each of these different types and different diameters, it is necessary to center the down hole tubular and rotate it in order to make up a string. Accordingly, although the centering and rotating may be done by separate devices, it would be more efficient if one device could be provided that is able to both center and rotate a down hole tubular.

Prior devices suitable for handling down hole tubulars are disclosed in U.S. Pat. Nos. 4,366,606 and 269/218,238 4,403,666 which are assigned to the assignee of the present application. In the '606 patent, there is disclosed a self-centering device for clamping a down hole tubular. The '666 device is used for lifting a down hole tubular. Neither of these devices provide for rotating a down hole tubular.

One prior device known for rotating a down hole tubular resembles the '606 invention. This prior rotating device includes a pair of opposed arms similar to those used in the '606 invention for clamping. On each of these arms, the prior roller device includes a pair of rollers attached to the arm for rotating a down hole tubular. The prior rotating device may be mounted to the drilling floor adjacent the drill axis. To operate the prior rotating device, the device is first positioned with respect to the string of down hole tubulars already in place so that when the arms with the rollers close upon and engage the length of down hole tubular to be added, it will be centered with respect to the drill axis of the string of down hole tubulars already in place. Then the length of down hole tubular to be added is suspended into position, centered by the prior device and rotated by the prior device onto the existing string of down hole tubulars. Then, a wrenching device engages the down hole tubulars and tightens the lengths of down hole tubular together to the required tongue.

The prior device has several disadvantages. The size and spacing of the pair of rollers on each opposing arm can only accommodate a limited range of diameters of down hole tubulars. For small diameter down hole tubulars, the size and spacing of these rollers must be small enough so that adjacent rollers do not interfere with each other when in the closed position. For large diameter down hole tubulars, the size and spacing of these rollers must be large enough to sufficiently engage and spin a down hole tubular between opposing roller pairs. If it is necessary to rotate a down hole tubular having a diameter outside of the range accommodated by the arms and rollers on the prior device, the old set of arms and rollers must be removed and a new set of arms and rollers having a different size and spacing must be installed. This operation can be lengthy and tedious and result in an interruption of operations and detract from efficiency.

Another disadvantage of the prior device is that it has a limited capture range for centering the down hole tubular to be added with respect to the existing string of down hole tubulars. If the down hole tubular to be added is not suspended closely in line with the existing string of down hole tubulars, the prior device will not engage it when it closes. Thus, time must be spent aligning the down hole tubular to be added before it is engaged and rotated by the prior device.

Accordingly, it is an object of the present invention to provide a means for centering and rotating a down hole tubular that includes a large capture region.

It is a further object of the present invention to provide a means to center and rotate a down hole tubular with the same device.

It is yet another object of the present invention to provide a centering spinner that can accommodate down hole tubulars having a range of diameters.

SUMMARY OF THE INVENTION

The present invention provides a centering spinner for down hole tubulars having a range of diameters. The centering spinner includes a frame capable of admitting a down hole tubular and a plurality of convergeable roller assemblies pivotally coupled to the frame.

According to another feature of the present invention, a centering spinner for down hole tubulars is provided that includes a plurality of convergeable rollers assemblies wherein adjacent rollers are displaced with respect to the axis of a down hole tubular retained therein so that adjacent rollers do not interfere with each other.

DESCRIPTION OF THE PREFERRED EMBODIMENTS

Figure 1:
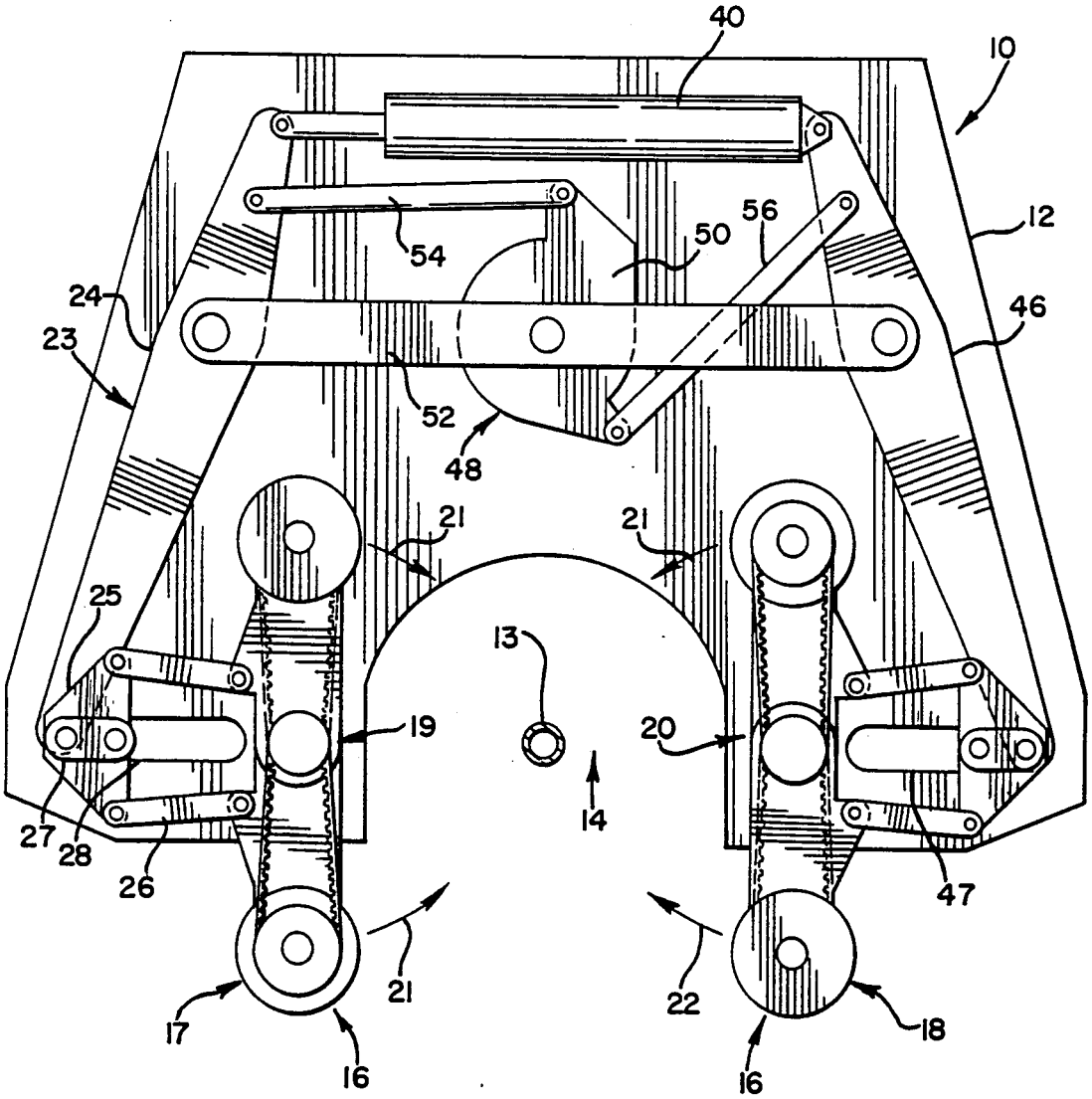
FIG. 1 is a top view of the interior of an embodiment of the present invention in the open position with a down hole tubular depicted positioned therein.

Referring to FIG. 1, there is depicted a top view of the interior of a preferred embodiment of the present invention. Centering spinner 10 comprises a lower frame 12 having a U-shaped opening 14 on one side adapted to receive a down hole tubular 13. A down hole tubular may be received in lower frame 12 in a manner similar to the method disclosed in the '666 patent referred to above and incorporated herein by reference. In the preferred embodiment, an upper frame 15 (shown in FIG. 3) is connected to lower frame 12 and is similar in construction and detail to lower frame 12. Together the frames 12, 15 comprise a frame assembly. This preferred frame assembly construction allows for positioning and alignment of the frame with respect to a down hole tubular and also provides an appropriate structure suitable for use with the other components of the preferred embodiment of the present invention. However, other shapes and configurations for the frame assembly can be envisioned, such as frame assemblies having only a single side (e.g., lower frame only instead of an upper and lower frame) or frames made up of more than two sides. Frames assemblies other than U-shaped may also be used (e.g., semi-circular, open box shaped, hinged) provided that a down hole tubular can be positioned between at least two points associated with the frame assembly.

In the preferred embodiment, centering spinner 10 is mounted on a drilling machine on or near the drilling floor (not shown). Mounting of the centering spinner could be similar to the mounting of the clamp of the '606 patent referred to above and incorporated herein by reference. Included in the mounting of the centering spinner may be a means for bringing the centering spinner into and out of position for operation. This could be accomplished in the manner disclosed with respect to the clamp of the '606 patent.

Located around opening 14 of lower frame 12 are a plurality of convergeable roller assemblies 16. In the preferred embodiment, there are two sets of roller assemblies—one on either side of opening 14—and each set includes two roller assemblies. The first set of roller assemblies 17 is pivotally coupled to frame 12 at axis 19 and the second set of roller assemblies is pivotally coupled at axis 20 which is opposite opening 14 from axis 19. Roller assemblies 16 are depicted in FIG. 1 in an open position to accommodate placement of a down hole tubular in or removal of a down hole tubular from centering spinner 10. To center and thereby align down hole tubular 13 in centering spinner 10, roller assemblies 16 converge on down hole tubular 13 by pivoting about axes 19 and 20 in the directions indicated by arrows 21 and 22.

Roller assemblies 16 operate to converge on the down hole tubular through the action of a linkage 23. In the preferred embodiment, linkage 23 includes symmetrical right and left sides that operate in coordination. A description of the left side of the linkage is provided with an understanding that a similar symmetrical right side is included in the preferred embodiment. Linkage 23 includes a rocker arm 24 pivotally coupled to member 25 which in turn connects to roller links 26 which in turn are connected to first set of roller assemblies 17. Member 25 allows connection of more than one roller link 26 to rocker arm 24 and coordinates the movement of the roller links and roller assemblies attached thereto. In addition, member 25 includes one or more bosses, such as boss 27, which extend into one or more corresponding guide slots in the frame assembly, such as guide slot 28 in lower frame 12. The guide slots define the range of movement and orientation of member 25 and consequently of roller links 26 and first set of roller assemblies 17. By means of boss 27 and guide slot 28, movement of rocker arm 24 is directed to bear evenly on first set of roller assemblies 17 causing them to converge in coordination on down hole tubular 13.

Linkage 23 in turn operates under force applied by an actuator 40. Actuator 40 may be a hydraulic cylinder driven by a hydraulic pump (not shown in this drawing), as is known in the art. Actuator 40 applies a force to rocker arm 24 which in turn forces the roller assemblies 16 to converge on the down hole tubular 13.

As mentioned above, linkage 23 preferably includes right and left sides. The right side of linkage 23 includes a second rocker arm 46 located opposite the opening 14 from first rocker arm 23. Second rocker arm 46 connects to the second set of roller assemblies 18 which are also located on the opposite side of opening 14. Second rocker arm 46 is also connected to actuator 40. Guide slots, such as a second guide slot 47 in lower frame 12, are located on the right side of opening 14 and coordinate and guide the convergence of second set of roller assemblies 18 by second rocker arm 46.

Linkage 23 also preferably includes a timing linkage 48 to coordinate the action and movement of first rocker arm 24 and second rocker arm 46. Timing linkage 48 includes a link 52 connecting first rocker arm 24 and second rocker arm 46. A timing cam 50 is rotatably coupled to link 52. Timing cam 50 is also coupled to first rocker arm 24 by a first timing link 54 and to second rocker arm 46 by a second timing link 56. With this timing linkage 48, movements of the rocker arms are coordinated thereby causing the first set of roller assemblies 17 and the second set of roller assemblies 18 to converge together simultaneously and symmetrically to center and align down hole tubular 13.

The aforedescribed linkage provides the advantage that it is self-centering, i.e., the linkage compensates for the arcing swing action of the rocker arms and other linkage members. The linkage translates the movement of the actuator to the rollers so that the rollers converge precisely at onepoint with respect to the frame assembly regardless of the size of the down hole tubular engaged therein. This allows the centering spinner to be precisely positioned and aligned with respect to the drill axis by positioning of the frame assembly only. The aforedescribed linkage is a preferred embodiment, however, other linkages could be envisioned that suitably translate and transfer the movements an actuator to the roller assemblies. The aforedescribed linkage of the present invention is similar to self-centering linkage of the '606 patent mentioned above and incorporated herein and further to which reference is made for further description of the self-centering linkage of the present invention.

Figure 2:
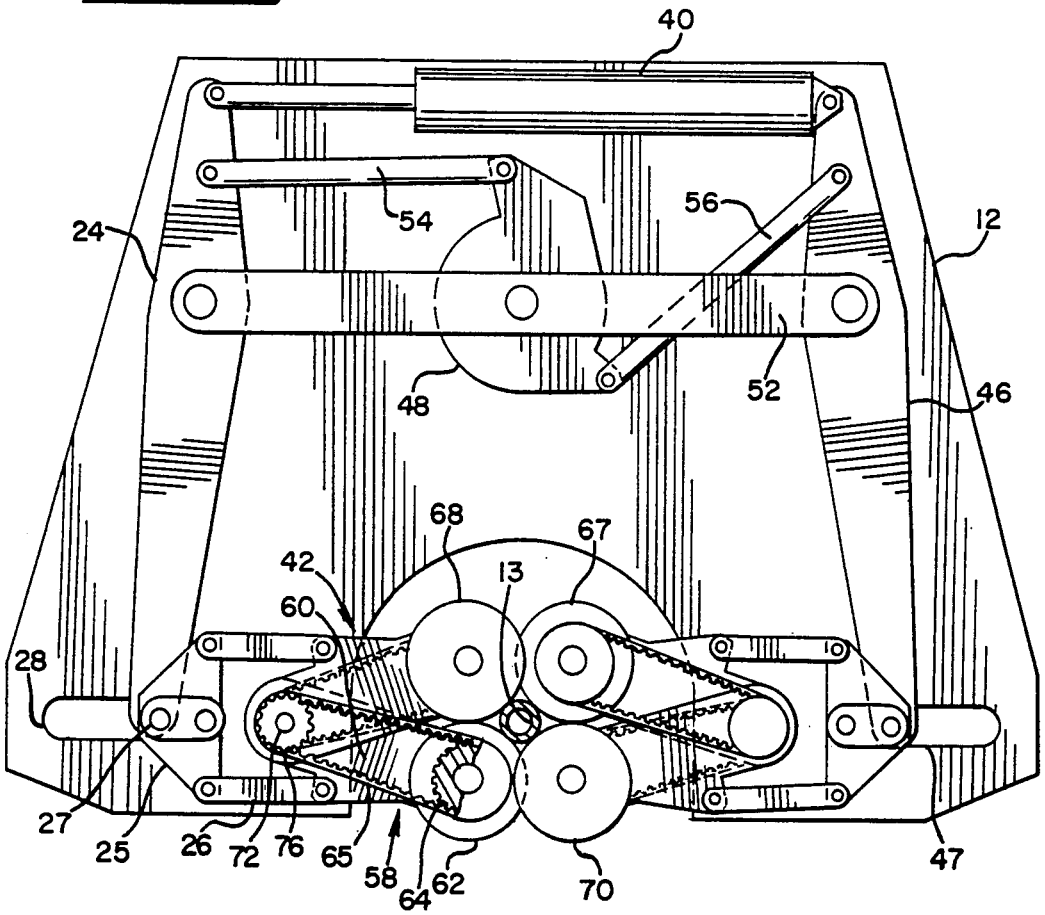
FIG. 2 is a top view of the interior of the embodiment of FIG. 1 in the closed position.

Referring to FIG. 2, there is depicted the embodiment of FIG. 1 now in the closed position. Spinning of down hole tubular 13 is accomplished after the down hole tubular 13 is centered by the roller assemblies. First and second sets of roller assemblies 17 and 18 preferably each include a pair of similar individual roller assemblies, such as first roller assembly 58. The following description of first roller assembly 58 may be considered to apply as well to the other roller assemblies.

First roller assembly 58 includes a roller arm 60 and a roller 62. Roller arm 60 is pivotally attached at one end to the frame 12 at axis point 19. At the other end of roller arm 60 is attached a rotatable roller 62 which can frictionally engage down hole tubular 13. In the preferred embodiment, roller 62 is made of knurled steel although other materials may be used.

A sprocket 64 is associated with roller 62. In the preferred embodiment, sprocket 64 is fixed to roller 62 so that the sprocket and roller will rotate together. Sprocket 64 is engaged by a toothed belt 65. A type of toothed belt that may be used is the Gates brand Poly Chain GT Belt system. Toothed belt 65 is driven by a hydraulic motor 66, shown in FIG. 3, in order to rotate sprocket 64 and roller 62 which in turn rotates (spins) a down hole tubular engaged in centering spinner 10. In the preferred embodiment, the hydraulic motor is of a type having low speed and high torque, such as the Char-Lynn brand model 2000 Series. The other rollers, such as rollers 67, 68, and 70 may be similarly connected to one or more other hydraulic motors by sprockets and belts. More than one roller can be driven from a single hydraulic motor by linking one or more belts from the motor to sprockets associated with each roller. In the preferred embodiment, two hydraulic motors are used, one for each set of roller assemblies. In the preferred embodiment, the hydraulic motor 66 drives belt 65 through a shaft 72 connected to gear 76 (shown in FIG. 2). Shaft 72 is coaxial with axis 19 to enable motor 66 and shaft 72 to connect to and drive both roller 62 (through gear 76, toothed belt 65, and sprocket 64) as well as roller 68 (through a similar gear belt, and sprocket, not shown in the Figures). Likewise, in the preferred embodiment, rollers 67 and 70 are each associated with separate sprockets, belts, and gears connected to a second hydraulic motor 80 and shaft 82 on the right side of the frame. Shaft 82 is coaxial with axis 20.

Alternatively, not all rollers need to be connected to a hydraulic motor. Some rollers can be used just to center and provide stability while others driven by a hydraulic motor are used for spinning the down hole tubular 13. Other types of hydraulic motors may be used as well as other means (e.g. chains, gears)

Figure 3:
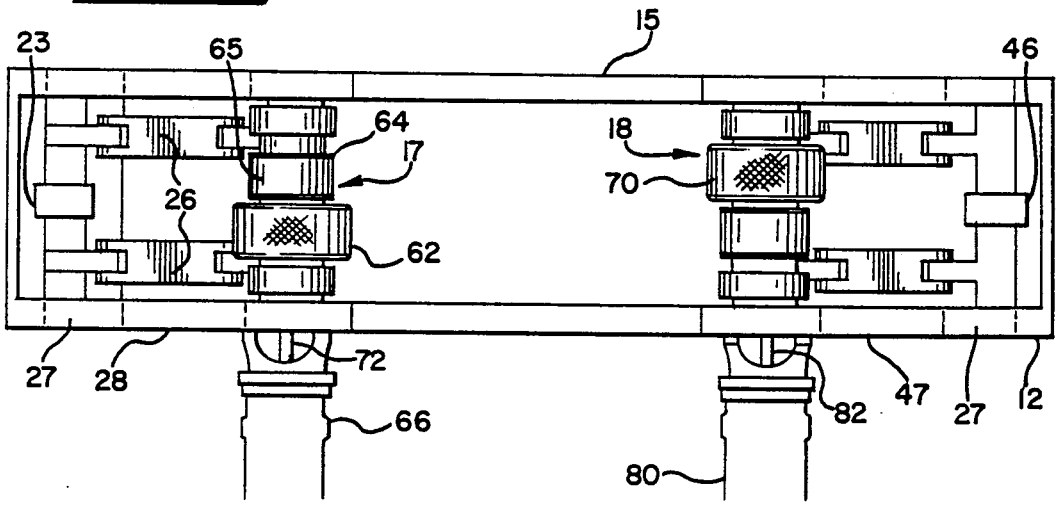
FIG. 3 is a side view of the embodiment of FIG. 1 but without the down hole tubular therein.

In the preferred embodiment, adjacent rollers are staggered from each other. Referring again to FIG. 2, rollers 68 and 70 (which, are opposite each other) overlap rollers 62 and 67 (which are opposite each other). This means that rollers 68 and 70 are axially displaced along the drill axis from rollers 62 and 67. In FIG. 3, roller 62 is shown to be lower than (or staggered from) roller 70. In this way, adjacent rollers (e.g. rollers 62 and 70) will not encroach upon or interfere with each other even in a closed position. This allows the centering spinner, without changing rollers, to accommodate a large range of diameters of down hole tubulars including small diameter down hole tubulars that require that the adjacent roller assemblies overlap as well as large diameter down hole tubulars that require greater size and spacing of rollers around the down hole tubular. Other staggering or overlapping configurations could be utilized.

The present invention also provides clear advantages over prior devices with respect to capture range. If the down hole tubular is not exactly aligned, the converging action of the present invention will capture, align, and center the down hole tubular. Because the present invention includes rollers that converge on a down hole tubular from more than two directions, a larger capture range can be provided than in prior devices that converge from only two directions. This eliminates or reduces a time consuming step associated with precise alignment of a down hole tubular in prior devices.

It is therefore intended that the foregoing detailed description be regarded as illustrative rather than limiting and that it be understood that it is the following claims, including all equivalents, which are intended to define the scope of the invention.

I claim:

1. A centering spinner for centering and spinning down hole tubulars having a range of diameters comprising:

a frame capable of admitting a down hole tubular therein, and a plurality of convergeable roller assemblies coupled to said frame for pivotal independent movement in relation therewith whereby a down hole tubular having a diameter within a large range of diameters can be centered and spun by said plurality of convergeable roller assemblies.

2. The centering spinner of claim 1 in which said plurality of convergeable roller assemblies are axially staggered.

3. The centering spinner of claim 1 comprising:

a linkage coupled to said plurality of roller assemblies to align and coordinate convergence of said plurality of roller assemblies.

4. The centering spinner of claim 3 in which said linkage is self-centering.

5. The centering spinner of claim 3 in which said linkage couples said plurality of roller assemblies to an actuator whereby a down hole tubular can be engaged and centered by a force applied to said linkage by the actuator.

6. The centering spinner of claim 1 further comprising:

a first shaft connected to said plurality of convergeable roller assemblies, whereby a down hole tubular can be spun in the centering spinner by application of a force to said first shaft.

7. The centering spinner of claim 6 in which said first shaft is connected to at least one of said plurality of ,convergeable roller assemblies at a point coaxial with the point at which said roller assembly is pivotally coupled to said frame.

8. The centering spinner of claim 7 further comprising:

a gear associated with said first shaft, a sprocket associated with said roller assembly, and a belt connecting said gear with said sprocket.

9. The centering spinner of claim 7 in which said first shaft is connected to at least two of said plurality of convergeable roller assemblies at a point coaxial with the point at which both of said two roller assemblies are pivotally coupled to said frame.

10. The centering spinner of claim 1 in Which said plurality of convergeable roller assemblies comprises:

a first set of roller assemblies pivotally coupled to said frame on one side of said frame, said first set of roller assemblies capable of converging upon and engaging a down hole tubular between said first set of convergeable roller assemblies and one or more roller assemblies coupled to said frame on another side in said frame opposite said first set of roller assemblies.

11. The centering spinner of claim 10 in which said first set of roller assemblies comprises:

a first roller arm assembly having a first roller arm pivotally coupled to said frame and a first roller rotatably coupled to said first roller arm 12. The centering spinner of claim 11 in which said first set of roller arm assemblies further comprises:

a second roller arm assembly having a second roller arm pivotally coupled to said frame and a second roller rotatably coupled to said second roller arm.

13. The centering spinner of claim 12 further comprising:

a second set of convergeable roller assemblies pivotally coupled to said frame opposite said first set of convergeable roller assemblies.

14. The centering spinner of claim 13 in which said second set of convergeable roller assemblies comprises:

a third roller arm assembly having a third roller arm pivotally coupled to said frame and a third roller rotatably coupled to said third roller arm, and a fourth roller arm assembly having a fourth roller arm pivotally coupled to said frame and a fourth roller rotatably coupled to said fourth roller arm.

15. The centering spinner of claim 13 further comprising:

a linkage coupling said plurality of roller assemblies to a actuator, said linkage including a first rocker arm pivotally coupled to said first set of roller assemblies and a second rocker arm pivotally coupled to said second set of roller assemblies whereby a down hole tubular can be engaged and centered by a force applied to said linkage from the actuator.

16. The centering spinner of claim 15 in which said linkage further comprises:

a first member connecting said first rocker arm to said first set of roller assemblies, said first member having a first boss slidably engaged in a first guide slot in said frame, and a second member connecting said second rocker arm to said second set of roller assemblies, said second member having a second boss slidably engaged in a second guide slot in said frame, whereby the range and movement of said plurality of roller assemblies can be defined and coordinated.

17. The centering spinner of claim 16 further comprising:

a timing linkage connecting said first rocker arm and said second rocker arm whereby the movement of said first rocker arm and said second rocker arm are coordinated.

18. The centering spinner of claim 17 in which said timing linkage comprises:

a link pivotally connected to said first rocker arm and said second rocker arm, a timing cam coupled to said link, a first timing link connecting said timing cam to said first rocker arm, and a second timing link connecting said timing cam to said second timing link.

19. A centering spinner for down hole tubulars having a range of diameters comprising:

a frame capable of admitting a down hole tubular, a first roller arm assembly pivotally coupled to said frame on one side of said frame, a second roller arm assembly pivotally coupled to said frame on the same side of said frame as said first roller assembly, a third roller arm assembly pivotally coupled to said frame on a side of said frame opposite said first roller arm assembly, a fourth roller arm assembly pivotally coupled to said frame on the same side of said frame as said third roller arm assembly, means for converging said roller arm assemblies, said converging means connected to said first roller arm assembly, said second roller arm assembly, said third roller arm assembly, and said fourth roller arm assembly, and means for spinning a down hole tubular, said spinning means connected to at least one roller arm assembly whereby a down hole tubular can be centered and spun.

20. The centering spinner of claim 19 in which said first roller, arm assembly includes a roller that is axially staggered with respect to a roller of at least one other roller arm assembly.

21. The centering spinner of claim 20 in which said converging means comprises:

linkage coupling said roller arm assemblies to an actuator whereby a down hole tubular can be engaged and centered by a force applied to said linkage by the actuator.

22. The centering spinner of claim 21 in which said linkage comprises:

a first rocker arm pivotally coupled to said first roller arm assembly and said second roller arm assembly, and a second rocker arm pivotally coupled to said third roller arm assembly and said fourth roller arm assembly.

23. The centering spinner of claim 22 further comprising:

timing linkage connecting said first rocker arm and said second rocker arm whereby movement of said first rocker arm and said second rocker arm are coordinated.

24. The centering spinner of claim 23 in which said timing linkage comprises:

a link pivotally connected to said first rocker arm and said second rocker arm, a timing cam coupled to said link, a first timing link connecting said timing cam to said first rocker arm and a second timing link connecting said timing cam to said second rocker arm.

25. A centering spinner for down hole tubulars having a range of diameters comprising:

a frame capable of admitting a down hole tubular, and a plurality of convergeable roller assemblies coupled to said frame, said plurality of convergeable roller assemblies including a plurality of rollers that can center and spin a down hole tubular in the opening in said frame, and further wherein adjacent rollers are displaced from each other in the direction of the axis of a down hole tubular retained therein, whereby a down hole tubular having a diameter in a wide range of diameters can be centered and spun.

26. A centering device for down hole tubulars having a range of diameters comprising:

a frame with an opening capable of admitting a down hole tubular, and a plurality of convergeable roller assemblies coupled to said frame and further in which said plurality of convergeable roller assemblies are adapted to converge from more than two directions upon a down hole tubular admitted in said frame.

27. The device of claim 26 further comprising:

a motor connected to said plurality of convergeable roller assemblies and adapted to spin the down hole tubular centered in said frame by said convergeable roller assemblies.

28. The centering device of claim 26 in which said plurality of convergeable roller assemblies is adapted to converge upon a down hole tubular admitted in said frame from four directions.

29. The centering device of claim 28 in which said plurality of convergeable roller assemblies comprises:

a first set of roller assemblies pivotally coupled to said frame on one side of the opening in said frame, said first set of roller assemblies capable of converging in more than one direction upon the down hole tubular admitted into said frame between said first and set of convergeable roller assemblies and a second set of roller assemblies coupled to said frame on another side of the opening in said frame opposite from said first set of roller assemblies.

30. A centering device for down hole tubulars having a range of diameters comprising:

a frame with an opening capable of admitting a down hole tubular, and a plurality of convergeable roller assemblies coupled to said frame and adapted to converge upon and center the down hole tubular admitted in said frame, and further in which said plurality of convergeable roller assemblies are axially staggered.

31. The device of claim 30 further comprising:

a motor connected to said plurality of convergeable roller assemblies and adapted to spin the down hole tubular centered in said frame by said convergeable roller assemblies.

* * * * *

UNITED STATES PATENT AND TRADEMARK OFFICE

CERTIFICATE OF CORRECTION

PATENT NO. : 5,054,550

DATED : October 8, 1991

INVENTOR(S) : Lee R. Hodge

It is certified that error appears in the above-identified patent and that said Letters Patent is hereby corrected as shown below:

IN THE BACKGROUND OF THE INVENTION

In column 1, line 20, please delete "sting" and substitute therefor --string--.

In column 1, line 52, please delete "269/218,238".

IN THE DESCRIPTION OF THE PREFERRED EMBODIMENTS

In column 4, line 48, please delete "onepoint" and substitute therefor --one point--.

In column 4, lines 55 and 56, please delete "the movements an actuator to the roller assemblies".

In column 5, line 45, after "gears)" please insert --for driving the rollers.--.

Column 6, line 59:
In claim 10, line 1, please delete "Which" and substitute therefor --which--.

Column 7, line 5:
In claim 11, line 5, after "arm" please insert --.--.

UNITED STATES PATENT AND TRADEMARK OFFICE

CERTIFICATE OF CORRECTION

PATENT NO. : 5,054,550

DATED : October 8, 1991

INVENTOR(S) : Lee R. Hodge

It is certified that error appears in the above-identified patent and that said Letters Patent is hereby corrected as shown below:

Column 8, line 17:
In claim 20, line 2, after the first occurrence of "roller" please delete ",".

Signed and Sealed this

Sixteenth Day of March, 1993

*Attest:*

STEPHEN G. KUNIN

*Attesting Officer*

*Acting Commissioner of Patents and Trademarks*

UNITED STATES PATENT AND TRADEMARK OFFICE

CERTIFICATE OF CORRECTION

PATENT NO. : 5,054,550

DATED : October 8, 1991

INVENTOR(S) : Lee R. Hodge

It is certified that error appears in the above-indentified patent and that said Letters Patent is hereby corrected as shown below:

On the title page, item [54] and column 1, line 2, please delete "SPINNING" and substitute therefor --SPINNER--.

Signed and Sealed this

Twenty-ninth Day of March, 1994

*Attest:*

*Attesting Officer*

BRUCE LEHMAN

*Commissioner of Patents and Trademarks*